United States Patent [19]

Pearlstein

[11] Patent Number: 4,472,008

[45] Date of Patent: Sep. 18, 1984

[54] CARRYING CASE FOR TOY CARS

[75] Inventor: Donald Pearlstein, Holliswood, N.Y.

[73] Assignee: Tara Toy Corp., Glendale, N.Y.

[21] Appl. No.: 444,415

[22] Filed: Nov. 24, 1982

[51] Int. Cl.[3] ..... A47F 1/00

[52] U.S. Cl. ..... 312/35; 312/305; 312/327

[58] Field of Search ..... 312/35, 11, 17, 18, 312/19, 120, 121, 125, 305, 327; 108/103, 139; 221/83, 93

[56] References Cited

U.S. PATENT DOCUMENTS

| | | | |
|---|---|---|---|
| 566,337 | 8/1896 | Raymond | 221/83 |
| 600,314 | 3/1898 | Howard | 312/35 |
| 1,327,142 | 1/1920 | Call | 312/18 |
| 1,397,615 | 11/1921 | Bassett | 221/83 |
| 1,398,778 | 11/1921 | Hawkins | 312/327 |
| 1,703,996 | 3/1929 | Gray | 312/35 |
| 1,743,931 | 1/1930 | Patton | 312/35 |
| 1,896,208 | 2/1933 | Thompson et al. | 312/35 |
| 1,969,401 | 8/1934 | Goodin | 221/83 |
| 2,488,798 | 11/1949 | Bouracier | 221/83 |
| 3,733,112 | 5/1973 | Marquardt | 312/125 |

FOREIGN PATENT DOCUMENTS

| | | | |
|---|---|---|---|
| 495677 | 5/1950 | Belgium | 221/83 |
| 553825 | 1/1957 | Italy | 221/83 |
| 279305 | 3/1952 | Switzerland | 312/305 |

*Primary Examiner*—William E. Lyddane
*Assistant Examiner*—Thomas A. Rendos
*Attorney, Agent, or Firm*—Alan H. Levine

[57] ABSTRACT

A portable carrying case for toy cars includes an outer housing connected to a handle. Within the outer housing is a turntable having several open-ended vehicle compartments which can hold a toy car in each. Between the outer housing and the handle is a movable gate adjacent to one compartment. Within the handle is a control shift lever, which not only causes the gate to open and to close the housing, but simultaneously also causes the turntable to rotate. There is also provided an indexing means which cooperates with the turntable, in order to limit the rotation of the turntable. Thus as the lever is shifted back and forth, one compartment at a time is rotated into position, and held there, adjacent to the movable gate.

12 Claims, 5 Drawing Figures

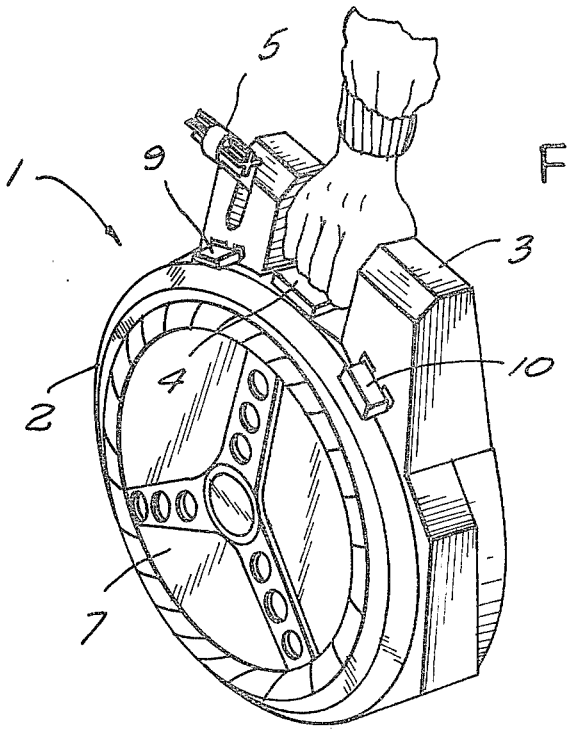
FIG. 1
FIG. 2
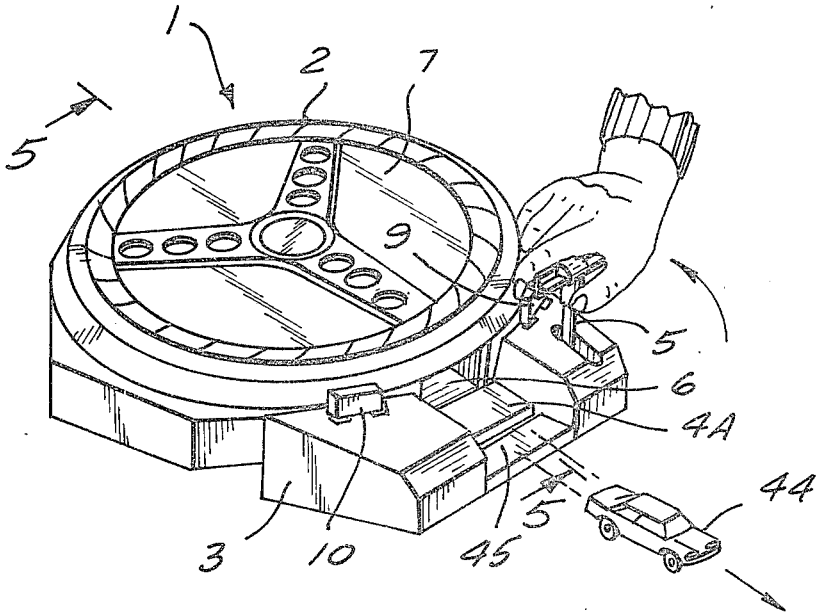

CARRYING CASE FOR TOY CARS

BACKGROUND OF THE INVENTION

Carrying cases for toy cars are known. Usually these cases are constructed like egg carrying cartons, since the case provides a stationary flat enclosed space for each car. The disadvantage is that the lid of the carrying case must be opened each time in order to remove a toy car from within.

It is also known to provide battery powered systems for activating toy cars and for causing these cars to move across a surface. The disadvantage is that the batteries may soon become discharged, and may constantly need to be replaced, especially after a period of prolonged use of the power system.

OBJECTS OF THE INVENTION

It is an object of the present invention to provide a portable carrying case for toy cars, containing a vehicle propulsion system for automatically discharging the toy cars one at a time from the case, which system is mechanically activated and gravity powered.

It is another object of the present invention to provide a portable carrying case having an exit gate for toy cars, containing a rotatable turntable having several vehicle compartments, and containing an indexing means which cooperates with the turntable, to limit its rotation, so that one compartment at a time is rotated into position, and held there, adjacent to the gate.

These and further objects of the present invention will become more apparent as the description thereof proceeds.

THE DRAWINGS

The present invention will now be described by reference to the following drawings which are not to be deemed limitative of the present invention in any manner thereof.

FIG. 1 shows a perspective view of the carrying case for toy cars being carried.

FIG. 2 shows a perspective view of the carrying case in operation allowing access to a discharged toy car.

DESCRIPTION OF THE INVENTION

Figure 3:
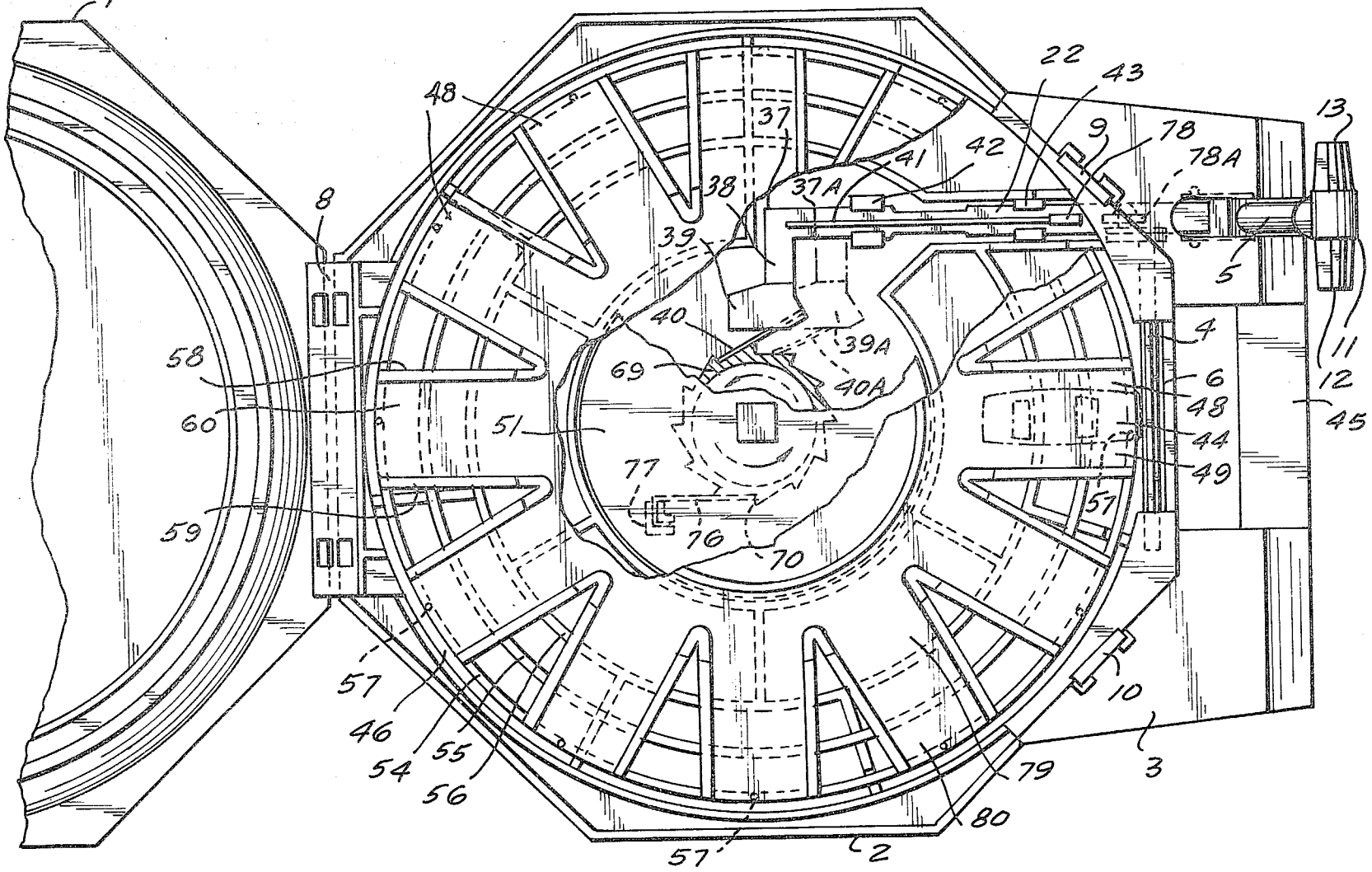
FIG. 3 shows a top view of the carrying case with the roof open and other parts broken away.

The present invention is directed to a portable carrying case for toy cars, containing a vehicle propulsion system for automatically discharging the toy cars one at a time from the case, which system is mechanically activated and gravity powered.

The present invention further provides a portable carrying case having an exit gate for toy cars, containing a rotatable turntable having several vehicle compartments, and containing an indexing means which cooperates with the turntable, to limit its rotation, so that one compartment at a time is rotated into position, and held there, adjacent to the gate.

As shown in FIGS. 1 and 2, the portable carrying case 1 includes an outer housing 2 connected to a handle means 3 with a movable gate 4 therebetween. The handle means contains a control shift lever 5 capable of being shifted between a first position, as shown in FIG. 1, and a second position, as shown in FIG. 2. FIG. 2 shows the exit opening 6 of the outer housing 2. Gate 4 can open, or can close, this exit opening 6.

Figure 5:
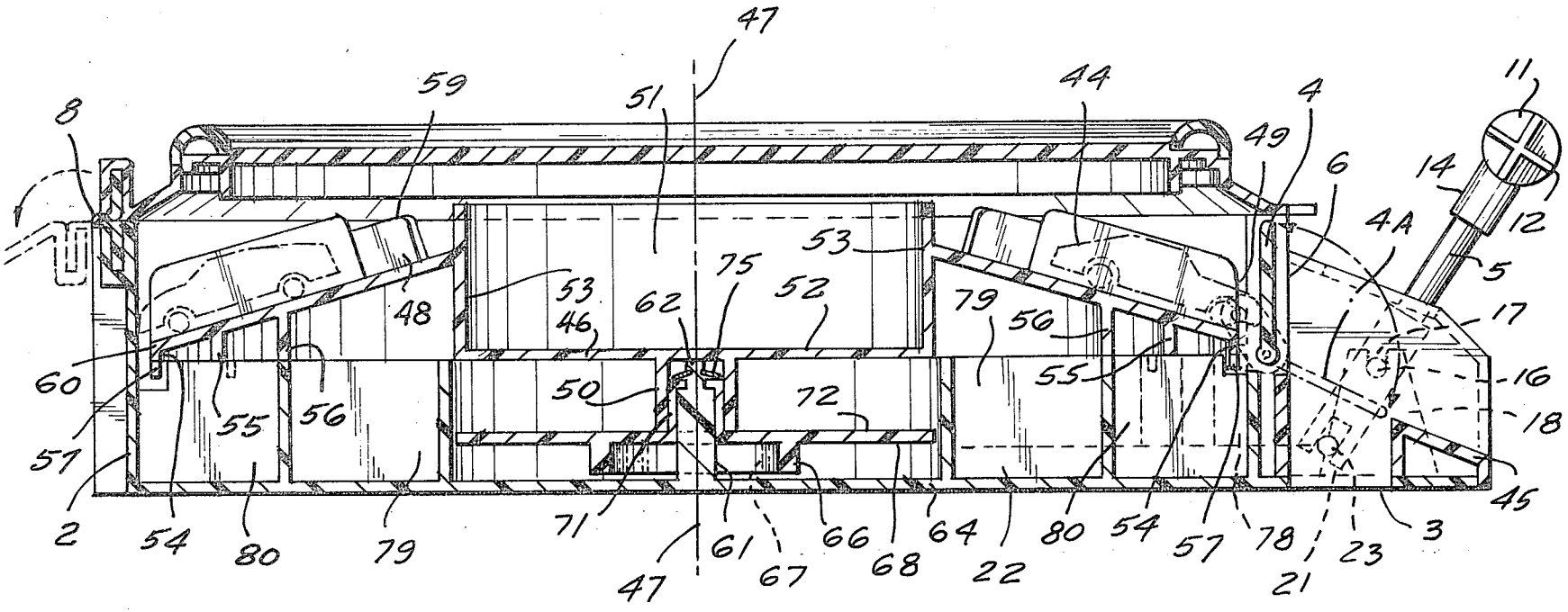
FIG. 5 shows a cross section view along line 5—5 of FIG. 2.

The roof 7 of the outer housing is shown closed in FIGS. 1, 2 and 5, and is shown open in FIG. 3. Sometimes roof 7 is given a decorative appearance, such as the steering wheel design shown in FIGS. 1 and 2. Roof 7 is used to open, or to close, the top of housing 2 by rotation around living hinge 8 which is shown in FIGS. 3 and 5. Roof 7 is held closed by means of clamps 9 and 10.

Lever 5 will now be discussed in greater detail by reference to FIGS. 3, 4 and 5, which show lever 5 in its first position. At the top end of the lever is a knob, or handle, 11 which is held within the grip of a person who desires to pivot the lever. The shape of knob 11 is such that it has a "+" cross-section at ends 12 and 13 thereof, to facilitate the firm gripping of this handle during use. Knob 11 is attached to the lever by sleeve means 14.

Lever 5 pivots about a fulcrum means 15 which includes shaft 16 which is rotatably held within groove 17 in each of the supporting uprights 18 and 19. The fulcrum means is located between the knob 11 at the top end of the lever and the bottom end of the lever.

The bottom end of the lever includes groove 20 which is the means for connecting the lever to the first end 21 of a reciprocating shaft 22. Pin 23 is part of the first end and is held within groove 20 so as to connect the reciprocating shaft to the bottom end of the lever. This first end 21 is located within the handle means 3, as shown specifically in FIG. 5.

Figure 4:
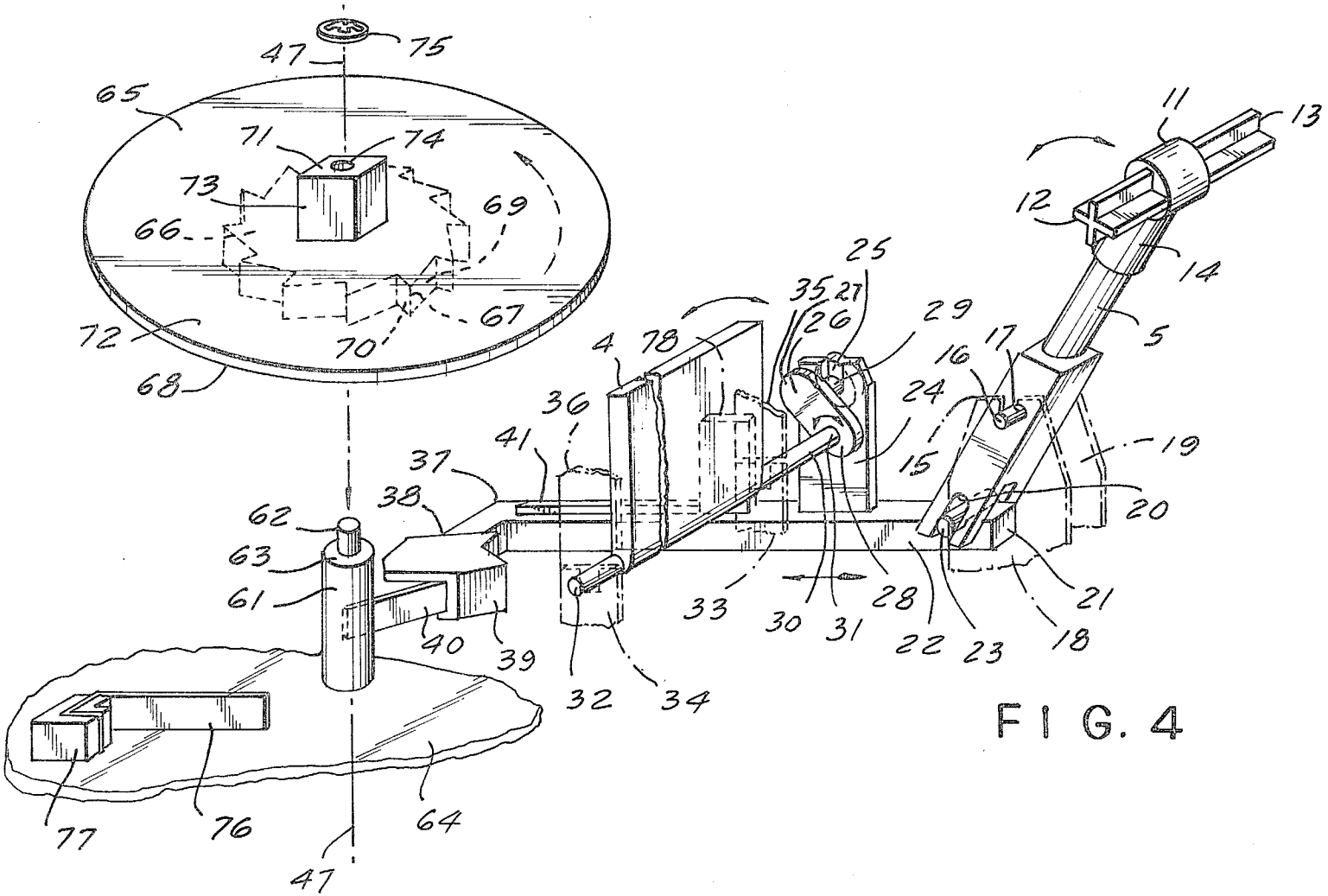
FIG. 4 shows a perspective view of the gate ramp control mechanism and the turntable indexing mechanism.

As shown in FIG. 4, bracket means 24 having a groove 25 at the top end thereof is attached at the bottom end thereof to the reciprocating shaft 22. Rocker arm 26 has a first end 27 and a second end 28. An axle 29 is loosely held at one end within the groove 25 of the bracket means. The axle 29 is attached at the other end to the first end 27 of the rocker arm. A rotatable shaft 30 is fixed at one end 31 to the second end 28 of the rocker arm. Movable gate 4 is attached at one end thereof along the length of the rotatable shaft 30 near the free end 32 of this shaft.

There is a first post 33 for holding up the fixed end 31 of the rotatable shaft 30; and there is a second post 34 for holding up the free end 32 of the shaft. A third post 35 is for holding down the fixed end 31 of the shaft, while a fourth post 36 is for holding down the free end 32 of the shaft.

The arrangement of these four posts is shown in FIG. 4. The first post 33 is below the fixed end 31 of the rotatable shaft 30, and the third post 35 is above the fixed end and vertically aligned with the first post. The second post 34 is below the free end 32 of the shaft, and the fourth post 36 is above the free end and vertically aligned with the second post. Thus posts 33, 34, 35 and 36 are so arranged as to permit rotational movement of the shaft 30, while preventing horizontal and vertical movement of the shaft.

The reciprocating shaft 22 further includes a second end 37 located within the outer housing 2, as specifically shown in FIG. 3. As shown in FIGS. 3 and 4, the shaft 22 has an L-shaped arm 38 at this second end. A sleeve means 39 is connected to the L-shaped arm; and a bar 40 is carried by the sleeve means. Straight line rib 41 is located on the upper surface of the shaft 22 between the first end 21 and the second end 37 of the shaft.

This rib 41 strengthens and stabilizes the shaft 22 during the reciprocating movement thereof. Folded partly over and around shaft 22 are clamps 42 and 43, which cooperate, as shown in FIG. 3, to guide the movement of the shaft in a straight line during its reciprocation.

Lever 5, when in its first position as shown by FIGS. 1, 3, 4 and 5, causes the second end 37 of the reciprocating shaft 22 to extend the maximum distance into the outer housing 2. Gate 4 closes the exit opening 6 of the outer housing, as specifically shown in FIG. 5. Lever 5, when shifted from its first position over to its second position as shown by FIG. 2, causes movement of the reciprocating shaft so that the first end 21 of the shaft extends the maximum distance into the handle means 3. The second end 37 of shaft 22 is shifted to phantom line position 37A, as specifically shown in FIG. 3. This movement of the reciprocating shaft causes the bracket means 24 of FIG. 4, the axle 29 and the first end 27 of the rocker arm 26 to move in a direction towards the handle means. This movement of the first end of the rocker arm causes the second end 28 of the rocker arm and the rotatable shaft 30 to rotate in the opposite direction causing the gate 4 to move so as to open the exit opening 6 of the outer housing.

With the lever in its second position as shown by FIG. 2, the vertically upright position of gate 4 of FIG. 5 will be changed to a downwardly sloping position of phantom line gate 4A of FIG. 5. Gate 4A then serves as a downwardly inclined temporary exit ramp, over which the toy car 44 will roll, pulled by the force of gravity, as it passes through the exit opening 6 and across the downwardly inclined threshold step 45 of the handle means. Threshold step 45 also serves as a means for gripping the handle 3, whenever the gate is closed, and the carrying case is to be carried, as in FIG. 1.

The lever, when reshifted from its second position and pivoted back to its first position, causes movement of the reciprocating shaft 22 so that the second end 37 of the shaft extends the maximum distance into the outer housing. Thus the second end of the shaft moves from the phantom line position 37A back to position 37, as shown in FIG. 3. This movement of the shaft causes the bracket means 24, the axle 29 and the first end 27 of the rocker arm 26 to move in a direction towards the outer housing. This movement of the first end 27 of the rocker arm causes the second end 28 of the rocker arm and the rotatable shaft 30 to rotate in the opposite direction causing gate 4 to move so as to close exit opening 6. Thus the gate moves from the ramp position 4A back upward to the vertical position 4, as shown in FIG. 5. Here again posts 33, 34, 35 and 36 permit rotational movement of the shaft 30, while preventing horizontal and vertical movement of the shaft 30.

Located within the outer housing 2 is a circular turntable 46, shown in FIGS. 3 and 5. The turntable is rotatable about a central axis 47, and it comprises more than one adjacent open-ended vehicle compartment 48 for holding a toy car 44. Each vehicle compartment has a vehicle opening 49 through which the car may pass. The vehicle opening is capable of being aligned with gate 4 and with the exit opening 6 of the outer housing. While FIG. 3 shows that there are twelve adjacent open-ended vehicle compartments, the number thereof will vary depending upon the width of the toy cars to be held in each compartment, and upon the diameter of the turntable.

The turntable 46 also includes a hollow pedestal 50 on the bottom surface of the turntable, and this pedestal is capable of supporting the turntable along the central axis 47. The pedestal is open at the bottom end thereof, and has a square interior surface. There is a U-shaped circular dish 51 in the center of the turntable. This dish has a flat bottom wall 52 with cylindrical side wall 53 extending vertically upwardly therefrom. The hollow pedestal 50 is attached at its top end to the flat bottom wall 52 of the dish.

As shown in FIGS. 3 and 5, there are three circular reinforcement ribs 54, 55 and 56 attached to the bottom surface of the turntable. There is one of these ribs, namely rib 54 which is the outermost rib, that has more than one downwardly pointing finger 57 attached along its circumference. There is one finger for each of the compartments 48, and each finger is located in the central portion of the underside of the compartment.

Each vehicle compartment is open-ended and comprises two vertical side walls 58 and 59 separated by a horizontal bottom wall 60. The compartment extends radially from a cylindrical side wall 53 outwardly over the reinforcement ribs 56 and 55 to the rib 54 at the outer edge of the turntable. The upper surface of the turntable is higher along the cylindrical side wall 53 and lower at the outer edge along rib 54, such that each compartment slopes downwardly from the cylindrical side wall to the outer edge. This creates that component part of the force of gravity which acts upon a toy car to power it downward over the downwardly inclined surface of the vehicle compartment.

As shown in FIGS. 4 and 5, there is a cylindrical pin means 61 having a narrow cylindrical head 62 above a wide cylindrical shoulder 63. Pin means 61 is attached to the bottom wall 64 of the outer housing and extends vertically upwardly therefrom along central axis 47.

As shown in FIGS. 4 and 5, there is a disc means 65 having a ratchet wheel 66 with ratchet teeth 67 on the bottom surface 68 thereof. Each ratchet tooth 67 has a top surface 69 and a back surface 70. Disc means 65 also has a plug means 71 extending from the bottom surface 68 upwardly through the disc means and onto the top surface 72 of the disc. The plug means 71 has a hollow interior cylindrical surface which conforms to the exterior cylindrical surface of the pin means 61 for the rotatable mating engagement thereof. The plug means has a square exterior surface 73 which conforms to the square interior surface of the hollow pedistal 50 for the nonrotatable and fixed mating engagement thereof.

Thus whenever the pin means is inserted all the way into the plug means, the disc means 65 will be rotatably supported above the bottom wall 64 of the outer housing by the pin means, along the central axis 47. This is because the narrow head 62 of the pin means can be inserted into, and then will protrude outwardly through, the circular opening 74 of plug means 71. Since shoulder 63 of the pin means is wider than the opening 74 of the plug means, and is unable to penetrate therethrough, the plug means will be rotatably supported on this shoulder. In order to prevent the plug means from inadvertently becoming dislodged from the pin means, a clasp 75 is placed upon that portion of the narrow head 62 which protrudes outwardly above the plug means 71. This is specifically shown in FIG. 5.

Whenever the plug means of the disc means is rotatably supported by the pin means, as discussed above, and this plug is then inserted into the hollow pedestal, the turntable 46 will be supported by the top surface 72 of the disc means along the central axis 47. The turntable and the disc means will be rotatable together as a synchronized unit about the pin means, because of the cylindrical mating surfaces discussed above. However the turntable and the disc means will not be able to rotate relative to each other, because of the square mating surfaces discussed above.

Referring now to FIGS. 3 and 4, there is an immovable stabilizer means 76 attached to bottom wall 64 by stationary holder block 77. This stabilizer means is located on that side of the pin means 61 which is opposite to the location of the bar 40 which is carried by the sleeve means 39.

Referring to FIGS. 3, 4 and 5, there is an indexing means 78 placed on the reciprocating shaft 22 at a certain location on the top surface of this shaft and adjacent to the side wall of the outer housing. Thus the downwardly pointing finger 57 of the turntable 46 will be intercepted by contact with this indexing means, as the turntable is caused to rotate.

As shown in FIG. 3, the lever, when in its first position, causes the bar 40 to rest upon the top surface 69 of a first ratchet tooth on one side of the ratchet wheel. This also causes the stabilizer means 76 to abut against the back surface 70 of another ratchet tooth on the opposite side of the ratchet wheel. Also the lever, when in its first position, as shown by FIG. 5, will cause the indexing means 78 to be so positioned that the downwardly pointing finger 57 will be intercepted by contact with this indexing means. This interception will limit the rotation of the turntable, so that one compartment 48 at a time, after having been rotated into position, will be held there adjacent to the gate.

The lever, when shifted from its first position to its second position (as shown by FIG. 2), will cause the second end 37 of shaft 22 to be retracted to location 37A, as shown by FIG. 3. This will cause sleeve means 39 to be retracted to phantom line location 39A, which in turn, will cause bar 40 to be retracted to phantom line location 40A. Thus bar 40 will rest, at location 40A, upon the top surface of a second adjacent ratchet tooth while the stabilizer means 76 continues to abutt against the same back surface 70 of the same ratchet tooth on the opposite side of the ratchet wheel. Also the lever, when shifted from its first position to its second position, will cause the indexing means 78 to be retracted to phantom line location 78A. This will cause the indexing means to be so positioned that the downwardly pointing finger will no longer be intercepted by contact with this indexing means. This will create an unobstructed path to permit the rotation of the turntable, whenever the lever is reshifted back to its first position.

Referring again to FIG. 3, the lever, when reshifted from its second position and pivoted back to its first position, will cause bar 40 to move from phantom line location 40A by advancing until it pushed against the back surface of the first ratchet tooth. This causes the ratchet wheel, the disc, the turntable and fingers 57 to rotate counterclockwise about axis 47. Eventually bar 40 will have pushed against this back surface to the maximum extent possible. At that point, bar 40 will then rest upon the top surface of the ratchet tooth. Simultaneously with the movement of bar 40 is the movement of indexing means 78, as it advances from phontom line location 78A to that certain solid line location shown in FIG. 3. The turntable and fingers will continue to rotate until the next downwardly pointing finger is intercepted by contacting the indexing means 78. This counterclockwise rotation of the ratchet wheel will cause the stabilizer means 76 to abut against the back surface of an adjacent ratchet tooth on that side of the ratchet wheel, which is opposite to the bar 40.

The stabilizer means thus prevents any reverse, or clockwise, rotation of the ratchet wheel, disc or turntable during the operation of the device. Thus the indexing means cooperates with the turntable, to limit its rotation, so that one compartment at a time is rotated into position, an held there, adjacent to the gate.

As shown in FIGS. 3 and 5 there are inner area units 79 and outer area units 80, both of which are located along the bottom wall 64 of the outer housing 2. The inner area units are those units which are closer to the central axis 47, while the outer area units are those units which are farther from the central axis 47. Both of these area units can be used for storage purposes, such as for storing extra toy cars.

The portable carrying case for toy cars would be operated as follows. The carrying case 1 would be placed on a flat level surface, as shown in FIG. 2, with the lever 5 in its first position, as shown by FIG. 1. If necessary, the roof 7 of the outer housing would be opened as shown in FIG. 3; and one toy car 44 would be loaded into each vehicle compartment 48 if empty. Then roof 7 is closed, and is held closed, by clamps 9 and 10. Since the lever is in its first position, gate 4 will be in a vertically upright position and will simultaneously close both the vehicle opening 49 and the exit opening 6, to prevent the movement of any toy car held in the compartment 48 adjacent to gate 4. A toy car positioned in any other compartment would be held in place, and would be prevented from moving, by contact with the side wall of the outer housing.

An external force is then manually applied to knob handle 11 of the control lever 5 in order to shift it from its first position to its second position, as shown in FIG. 2. This causes gate 4 to rotate to a downward position so as to simultaneously open both the vehicle opening and the exit opening. Gate 4 also serves as a temporary exit ramp 4A over which a toy car 44 can be discharged out of the compartment, out of the housing and out of the carrying case onto the flat level surface.

An external force is then manually applied in the opposite direction to the knob handle of the control lever in order to reshift it from the second position back to its first position. This causes turntable 46 to rotate counterclockwise about its central axis until the vehicle opening of an adjacent compartment is aligned with the exit opening 6 of the housing. This reshifting of the lever simultaneously causes the gate 4 to rotate from the ramp position 4A back upward to its vertically upright position, so as to close both the vehicle opening and the exit opening. This will prevent the movement of any toy car held in the adjacent compartment.

The above procedure may then be repeated as often as necessary in order to discharge as many toy cars as are desired.

The kinds of toy cars to be used with the carrying case include mini-die-cast cars, such as Matchbox cars, Hot Wheels cars, and/or Fast-III cars.

Three of the component parts of the carrying case are made of a strong flexible metal, such as spring steel. These three are bar 40, clasp 75 and stabilizer means 76. All of the various other component parts of the carrying case are made of a molded plastic, such as a thermoplastic material or a thermosetting material.

The term, vehicle propulsion system, refers to those structural parts which provide for the automatic discharging of the toy cars one at a time from the portable carrying case. Hence these structural parts include the turntable, the vehicle compartment, the movable gate which becomes a temporary exit ramp, and the threshold step.

The term, mechanically activated, refers to manually applying an external force to pivot the control shift lever, in order to move the reciprocating shaft back and forth, so as to cause the gate to open and to close the housing and simulataneously to cause the turntable to rotate, in order to permit the automatic discharging of toy cars one at a time from the carrying case.

The term, gravity powered, refers to that component part of the force of gravity which acts upon a toy car urging it downward over the downwardly inclined surface of the vehicle compartment, across the downwardly inclined exit ramp, and over the downwardly inclined threshold step, in order to permit the automatic discharging of the toy cars one at a time from the carrying case.

The present invention has the following advantages. The present invention provides a portable carrying case for toy cars, containing a vehicle propulsion system for automatically discharging the toy cars one at a time from the case, which system is mechanically activated and gravity powered. Since the operation of this system relies upon the force of gravity, and does not rely upon battery power, the system is much more dependable. The system can be utilized for unlimited periods of time, because there are no batteries to become discharged, or need to be replaced, especially after a period of prolonged use of the power system. The toy cars are automatically discharged, one at a time, through the exit gate of the carrying case. This is because the carrying case contains a rotatable turntable having several vehicle compartments and also contains an indexing means which cooperates with the turntable, to limit its rotation, so that one compartment at a time is rotated into position, and held there, adjacent to the gate.

Although the present invention has been disclosed in connection with a few preferred embodiments thereof, variations and modifications may be resorted to by those skilled in the art without departing from the principles of the new invention. All of these variations and modification are considered to be within the true spirit and scope of the present invention as disclosed in the foregoing description and defined by the appended claims.

What is claimed is:

1. A portable carrying case for toy cars comprising:
- an outer housing having an exit opening,
- a rotatable turntable within said housing, said turntable having a plurality of compartments along its periphery for holding toy cars,
- a vehicle opening in each compartment,
- indexing means associated with the turntable for rotating said turntable to bring the vehicle openings of different ones of said compartments into registry with said housing exit opening,
- a gate carried by the housing and movable between a position in which it blocks movement of a toy car through said exit opening and a position in which it permits such movement of a toy car,
- gate control means carried by the housing for moving said gate, and
- a single manually operable handle lever carried by the housing and movable between a first position and a second position, said handle lever operatively connected with said indexing means and said gate control means for simultaneously rotating said turntable and moving said gate.

2. The portable carrying case of claim 1 wherein when said gate moves to its position for permitting movement of a toy car through said exit opening it assumes an inclined orientation and serves as a ramp over which a toy car can move out of its compartment.

3. The portable carrying case of claim 1, wherein said handle lever operative connection includes a reciprocating shaft having a first end located within said handle lever and a second end located within said outer housing,
- a bracket means having a groove at one end and being attached at its other end to said reciprocating shaft,
- a rocker arm having a first end and a second end,
- an axle loosely held at one end within said groove of said bracket means, and attached at the other end to said first end of said rocker arm, and
- a rotatable shaft fixed at one end to said second end of said rocker arm, with said movable gate being attached at one end thereof along the length of said rotatable shaft near the free end of said rotatable shaft.

4. The portable carrying case of claim 3, further comprising
- a first post for holding up the fixed end of said rotatable shaft, and
- a second post for holding up the free end of said rotatable shaft.

5. The portable carrying case of claim 4, further comprising
- a third post for holding down the fixed end of said rotatable shaft, and
- a fourth post for holding down the free end of said rotatable shaft.

6. The portable carrying case of claim 5,
- wherein said first post is below said fixed end of said rotatable shaft, and said third post is above said fixed end and vertically aligned with said first post, and
- wherein said second post is below said free end of said rotatable shaft, and said fourth post is above said free end and vertically aligned with said second post,
- whereby said posts are so arranged as to permit rotation of said shaft, while preventing horizontal and vertical movement of said shaft.

7. The portable carrying case of claim 3, further comprising
- a knob at the top end of said lever,
- means for connecting the bottom end of said lever to said first end of said reciprocating shaft, and
- fulcrum means, about which said lever pivots, located between said knob and said bottom end of said lever.

8. The portable carrying case of claim 7,
- wherein said lever, when in its first position, causing the second end of said reciprocating shaft to extend the maximum distance into said outer housing,
- wherein said lever, when shifted from said first position to said second position, causing movement of said reciprocating shaft so that said first end of said reciprocating shaft extends the maximum distance into said handle means, said movement of said reciprocating shaft causing said bracket means, said axle and said first end of said rocker arm to move in a direction towards said handle means, said movement of said first end of said rocker arm causing said second end of said rocker arm and said rotatable shaft to rotate in the opposite direction causing said gate to move so as to simultaneously open both said vehicle opening and said exit opening, and wherein said lever, when reshifted from said second position back to said first position, causing movement of said reciprocating shaft so that said second end of said reciprocating shaft extends the maximum distance into said outer housing, said movement of said reciprocating shaft cuasing said bracket means, said axle and said first end of said rocker arm to move in a direction towards said outer housing, said movement of said first end of said rocker arm causing said second end of said rocker arm and said rotatable shaft to rotate in the opposite direction causing said gate to move so as to simultaneously close both said vehicle opening and said exit opening.

9. The portable carrying case of claim 7, wherein said turntable is circular and further comprises a hollow pedestal on the bottom surface of said turntable and capable of supporting said turntable along said central axis, said pedestal being open at the bottom end thereof, a U-shaped dish in the center of said turntable, said dish having a flat bottom wall with a cylindrical side wall, extending vertically upwardly therefrom, said hollow pedestal being attached at the top end thereof to said flat bottom wall of said dish, at least one circular reinforcement rib attached to the bottom surface of said turntable, said rib having more than one downwardly pointing finger along its circumference, with there being one finger for each of said compartments, and each finger being located in the central portion of the underside of said compartment, each of said compartments comprising two vertical side walls separated by a horizontal bottom wall, said compartment extending radially from said cylindrical side wall outwardly over said reinforcement rib to the outer edge of said turntable, and the upper surface of said turntable being higher along the cylindrical side wall and lower at the outer edge, such that each compartment slopes downwardly from said cylindrical side wall to said outer edge.

10. The portable carrying case of claim 9 further comprising, a cylindrical pin means having a narrow head above a wide shoulder, attached to the bottom wall of said outer housing and extending vertically upwardly therefrom along said central axis, a disc means having a ratchet wheel with ratchet teeth on the bottom surface thereof and having a plug means extending from said bottom surface upwardly through said disc means and onto the top surface of said disc means, said plug means having a hollow interior surface which conforms to the exterior surface of said pin means for the rotatable mating engagement thereof, said plug means having an exterior surface which conforms to the interior surface of said hollow pedestal for the nonrotatable mating engagement thereof, such that whenever said pin means is inserted into said plug means, said disc means is rotatably supported above the bottom wall of said outer housing by said pin means along said central axis, and such that whenever said plug means of said rotatably supported disc means is inserted into said hollow pedestal, said turntable is supported on the top surface of said disc means along said central axis, with said turntable and said disc means rotatable together as a synchronoized unit about said pin means.

11. The portable carrying case of claim 10 wherein said reciprocating shaft further comprises, an L-shaped arm at the second end of said shaft, a sleeve means connected to said L-shaped arm, a bar carried by said sleeve means and located on one side of said pin means, an indexing means placed on said reciprocating shaft at a certain location wherein one of said downwardly pointing fingers of said turntable will be intercepted by contact with said indexing means, and wherein said outer housing further comprises a stabilizer means attached to the bottom wall thereof and located on that side of the pin means which is opposite to the location of said bar.

12. The portable carrying case of claim 11, wherein said lever, when in its first position, causing said bar to rest upon the top surface of a first ratchet tooth on one side of said ratchet wheel and causing said stabilizer means to abut against the back surface of another ratchet tooth on the opposite side of said ratchet wheel, wherein said lever, when shifted from said first position to said second position, causing said bar to be retracted so as to rest upon the top surface of a second adjacent ratchet tooth while said stabilizer means continues to abut against the same back surface of the same ratchet tooth on the opposite side of said ratchet wheel, and wherein said lever, when reshifted from said second position back to said first position, causing said bar to advance until it pushes against the back surface of said first ratchet tooth which causes said turntable to rotate about said axis until one of said downwardly pointing fingers is intercepted by contacting said indexing means, and causing said stabilizer means to abut against the back surface of an adjacent ratchet tooth on that side of said ratchet wheel which is opposite to said bar.

* * * * *